US009903379B2

(12) United States Patent
Iizuka et al.

(10) Patent No.: US 9,903,379 B2
(45) Date of Patent: Feb. 27, 2018

(54) VARIABLE NOZZLE UNIT AND VARIABLE GEOMETRY SYSTEM TURBOCHARGER

(71) Applicant: IHI Corporation, Koto-ku (JP)

(72) Inventors: Kuniaki Iizuka, Tokyo (JP); Yoshinari Yoshida, Tokyo (JP); Yasushi Asada, Tokyo (JP); Osamu Kagimoto, Tokyo (JP); Hideumi Ohkuma, Tokyo (JP); Yohei Suruga, Tokyo (JP); Toshihiko Kitazawa, Tokyo (JP)

(73) Assignee: IHI CORPORATION, Koto-ku (JP)

( * ) Notice: Subject to any disclaimer, the term of this patent is extended or adjusted under 35 U.S.C. 154(b) by 493 days.

(21) Appl. No.: 14/589,316

(22) Filed: Jan. 5, 2015

(65) Prior Publication Data

US 2015/0110607 A1 Apr. 23, 2015

Related U.S. Application Data

(63) Continuation of application No. PCT/JP2013/073265, filed on Aug. 30, 2013.

(30) Foreign Application Priority Data

Sep. 13, 2012 (JP) ..... 2012-201268

(51) Int. Cl.
*F04D 27/00* (2006.01)
*F04D 17/10* (2006.01)
(Continued)

(52) U.S. Cl.
CPC ..... *F04D 27/002* (2013.01); *F01D 17/165* (2013.01); *F04D 17/10* (2013.01); *F02B 37/24* (2013.01); *F05D 2220/40* (2013.01)

(58) Field of Classification Search
CPC ..... F01D 17/165; F01D 9/041; F01D 9/042; F01D 9/047; F02B 37/24; F05D 2220/40; F04D 17/10; F04D 27/002; F02C 6/12
See application file for complete search history.

(56) References Cited

U.S. PATENT DOCUMENTS 5,083,053 A * 1/1992 New ..... F16C 17/02 310/64
2001/0017032 A1 8/2001 Jinnai
(Continued)

FOREIGN PATENT DOCUMENTS

CN 1307171 A 3/2001
JP S61-70105 A1 4/1986
(Continued)

OTHER PUBLICATIONS

EPO, Description JP2010270638, retrieved Apr. 24, 2017.*
(Continued)

*Primary Examiner* — Woody Lee, Jr.
*Assistant Examiner* — Jesse Prager
(74) *Attorney, Agent, or Firm* — Oblon, McClelland, Maier & Neustadt, L.L.P.

(57) ABSTRACT

An inner surface of each first supporting hole of a shroud ring has on both sides in the axial direction of a turbine impeller two first bearing portions by which first nozzle shaft is rotatably supported. An inner surface of each second supporting hole of a nozzle ring has a second bearing portion by which a second nozzle shaft is rotatably supported. The fitting clearance between the second bearing portion and the second nozzle shaft is set larger than the fitting clearance between each of the first bearing portions and the first nozzle shaft.

5 Claims, 5 Drawing Sheets

(51) Int. Cl.
*F01D 17/16* (2006.01)
*F02B 37/24* (2006.01)

(56) References Cited

U.S. PATENT DOCUMENTS

2011/0314808 A1* 12/2011 Mohamed ..... F01D 5/141
60/602
2012/0301288 A1* 11/2012 Maier ..... F01D 17/165
415/208.1

FOREIGN PATENT DOCUMENTS

| | | | | |
|---|---|---|---|---|
| JP | 2004-270472 | A1 | | 9/2004 |
| JP | 2009-243300 | A1 | | 10/2009 |
| JP | 2009-243375 | A1 | | 10/2009 |
| JP | 2010-001863 | A1 | | 1/2010 |
| JP | 2010-071142 | A1 | | 4/2010 |
| JP | 2010270638 | A | * | 12/2010 |
| JP | 2012-102660 | A1 | | 5/2012 |

OTHER PUBLICATIONS

International Search Report dated Nov. 5, 2013 for PCT/JP2013/073265 filed on Aug. 30, 2013 with English Translation.
Written Opinion dated Nov. 5, 2013 for PCT/JP2013/073265 filed on Aug. 30, 2013.
Combined Chinese Office Action and Search Report dated Jun. 29, 2016 in Patent Application No. 20138037551.9 (with English translation of categories of cited documents).
U.S. Appl. No. 14/588,508, filed Jan. 2, 2015, Iizuka, et al.

* cited by examiner

VARIABLE NOZZLE UNIT AND VARIABLE GEOMETRY SYSTEM TURBOCHARGER

CROSS REFERENCE TO RELATED APPLICATIONS

This application is a continuation application of International Application No. PCT/JP2013/073265, filed on Aug. 30, 2013, which claims priority to Japanese Patent Application No. 2012-201268, filed on Sep. 13, 2012, the entire contents of which are incorporated by references herein.

BACKGROUND OF THE INVENTION

1. Field of the Invention

The present invention relates to a variable nozzle unit which can alter a passage area for (a flow rate of) gas such as exhaust gas to be supplied to a turbine impeller in turbo rotating machinery such as a variable geometry system turbocharger or a gas turbine, and relates to a variable geometry system turbocharger.

2. Description of the Related Art

In recent years, various variable nozzle units for use in variable geometry system turbochargers have been developed. A general configuration of a conventional variable nozzle unit will be described below.

In a housing of a variable geometry system turbocharger, a shroud ring as a first base ring is provided concentrically with a turbine impeller. A plurality of first supporting holes are formed in the shroud ring at equal intervals in the circumferential direction of the shroud ring. Moreover, a nozzle ring as a second base ring is provided at a position away from and facing the shroud ring in the axial direction of the turbine impeller integrally and concentrically with the shroud ring. A plurality of second supporting holes are formed in the nozzle ring at equal intervals in the circumferential direction of the nozzle ring in such a manner as to match the plurality of first supporting holes of the shroud ring.

A plurality of variable nozzles are disposed between a facing surface of the shroud ring and a facing surface of the nozzle ring at equal intervals in the circumferential direction of the shroud ring (nozzle ring). Each variable nozzle is rotatable in both the forward and reverse directions about an axis parallel to the turbine impeller. Moreover, a first nozzle shaft is integrally formed on a side surface of each variable nozzle on one side in the axial direction. Each first nozzle shaft is rotatably supported by the corresponding supporting hole of the shroud ring. Further, a second nozzle shaft is formed on a side surface of each variable nozzle on the other side in the axial direction integrally and concentrically with the first nozzle shaft. Each second nozzle shaft is rotatably supported by the corresponding second supporting hole of the nozzle ring.

A link mechanism for synchronously rotating the plurality of variable nozzles in the forward and reverse directions is provided on the opposite side of the shroud ring from the facing surface. Synchronously rotating the plurality of variable nozzles in the forward direction (opening direction) increases the passage area of exhaust gas to be supplied to the turbine impeller. Synchronously rotating the plurality of variable nozzles in the reverse direction (closing direction) decreases the passage area of the exhaust gas.

A nozzle supporting structure for supporting the variable nozzle will be described below.

The inner surface of the first supporting hole of the shroud ring has on one side in the axial direction a first bearing portion by which the first nozzle shaft of the variable nozzle is rotatably supported. The inner surface of the second supporting hole of the nozzle ring has a second bearing portion by which the second nozzle shaft of the variable nozzle is rotatably supported. In other words, the variable nozzle is supported on both sides from both sides of the variable nozzle in the axial direction by the first bearing portion and the second bearing portion. The fitting clearance between the first bearing portion and the first nozzle shaft and the fitting clearance between the second bearing portion and the second nozzle shaft are set to the same value to an accuracy of several tens of micrometers.

Meanwhile, in some conventional variable nozzle units, the plurality of second supporting holes are omitted from the nozzle ring, and the second nozzle shafts are omitted from the variable nozzles. In such a case, the inner surface of the first supporting hole of the shroud ring has on both sides in the axial direction two first bearing portions by which the first nozzle shaft of the variable nozzle is rotatably supported. In other words, the variable nozzle is supported on one side from one side of the variable nozzle in the axial direction by the two first bearing portions. The fitting clearance between one of the two first bearing portions and the first nozzle shaft and the fitting clearance between the other of the two first bearing portions and the first nozzle shaft are set to the same value to an accuracy of several tens of micrometers.

It should be noted that conventional techniques relating to the present invention are disclosed in Japanese Patent Application Laid-Open Publications Nos. 2012-102660 and 2010-71142.

SUMMARY OF THE INVENTION

In a variable nozzle unit of a type in which a nozzle is supported on both sides, the inclination of the axis of the variable nozzle with respect to the axis of the first supporting hole of the shroud ring during the operation of the variable geometry system turbocharger can be smaller than in a variable nozzle unit of a type in which a nozzle is supported on one side. However, the first bearing portion and the second bearing portion need to be respectively formed in the shroud ring and the nozzle ring separately prepared. This makes it difficult to sufficiently ensure the accuracy of the relative position between a hole constituting the first bearing portion and a hole constituting the second bearing portion. Moreover, before the nozzle ring is attached to the shroud ring, the variable nozzle is supported by only one first bearing portion. In this state, the axis of the variable nozzle is prone to incline with respect to the axis of the first supporting hole of the shroud ring. Accordingly, a special jig is needed when the nozzle ring is attached to the shroud ring, and the assembly work of the variable nozzle unit becomes complicated.

On the other hand, in a variable nozzle unit of a type in which a nozzle is supported on one side, the variable nozzle is supported by the two first bearing portions in a stabler state before the nozzle ring is attached to the shroud ring, than in a variable nozzle unit of a type in which a nozzle is supported on both sides. However, the inclination of the axis of the variable nozzle with respect to the axis of the supporting hole of the shroud ring during the operation of the variable geometry system turbocharger tends to be large. Accordingly, during the operation of the variable geometry system turbocharger, as wear between the first bearing portion on the side closer to the side surface of the variable nozzle and the first nozzle shaft proceeds, the non-smooth movement of the variable nozzle occurs, and may often become likely to cause the malfunction of the variable nozzle unit.

In other words, there is a problem that it is difficult to improve the efficiency of the assembly work of the variable nozzle unit while stabilizing the operation of the variable nozzle unit by reducing the non-smooth movement of the variable nozzle during the operation of the variable geometry system turbocharger. It should be noted that the above-described problem also occurs in a variable nozzle unit used in turbo rotating machinery such as a gas turbine.

An object of the present invention is to provide a variable nozzle unit and a variable geometry system turbocharger which can improve the working efficiency of assembling the variable nozzle unit while stabilizing the operation of the variable nozzle unit.

A first aspect of the present invention is a variable nozzle unit configured to alter a passage area of gas to be supplied to a turbine impeller of turbo rotating machinery, the variable nozzle unit including: a first base ring provided in a housing of the turbo rotating machinery concentrically with the turbine impeller, the first base ring including a plurality of first supporting holes formed in a circumferential direction thereof; a second base ring provided at a position away from and facing the first base ring in an axial direction of the turbine impeller integrally and concentrically with the first base ring, the second base ring including a plurality of second supporting holes formed in a circumferential direction thereof in such a manner as to match the plurality of the first supporting holes of the first base ring; a plurality of variable nozzles disposed between a facing surface of the first base ring and a facing surface of the second base ring in a circumferential direction of the first and second base rings, each variable nozzle being rotatable in both of forward and reverse directions about an axis parallel to an axis of the turbine impeller and including a first nozzle shaft integrally formed on a side surface thereof on one side in the axial direction and rotatably supported by the corresponding first supporting hole of the first base ring and a second nozzle shaft formed on a side surface thereof on another side in the axial direction integrally and concentrically with the first nozzle shaft and rotatably supported by the corresponding second supporting hole of the second base ring; and a link mechanism configured to synchronously rotating the plurality of variable nozzles in the forward and reverse directions, wherein an inner surface of each first supporting hole of the first base ring includes on both sides in the axial direction two first bearing portions by which the first nozzle shaft of the variable nozzle is rotatably supported, an inner surface of each second supporting hole of the second base ring includes a second bearing portion by which the second nozzle shaft of the variable nozzle is rotatably supported, and a fitting clearance between the second bearing portion and the second nozzle shaft of the variable nozzle is set larger than a fitting clearance between each of the first bearing portions and the first nozzle shaft of the variable nozzle.

In the specification and claims of the present application, the meaning of "turbo rotating machinery" includes a variable geometry system turbocharger and a gas turbine, the meaning of "provided" includes provided indirectly with the interposition of another member as well as provided directly, and the meaning of "disposed" includes disposed indirectly with the interposition of another member as well as disposed directly.

A second aspect of the present invention is a variable geometry system turbocharger for turbocharging air to be supplied to an engine side using pressure energy of gas from the engine, the variable geometry system turbocharger including the variable nozzle unit according to the first aspect.

The present invention can provide a variable nozzle unit and a variable geometry system turbocharger which can improve the working efficiency of assembling the variable nozzle unit while stabilizing the operation of the variable nozzle unit.

DESCRIPTION OF THE PREFERRED EMBODIMENTS

Figure 1A:
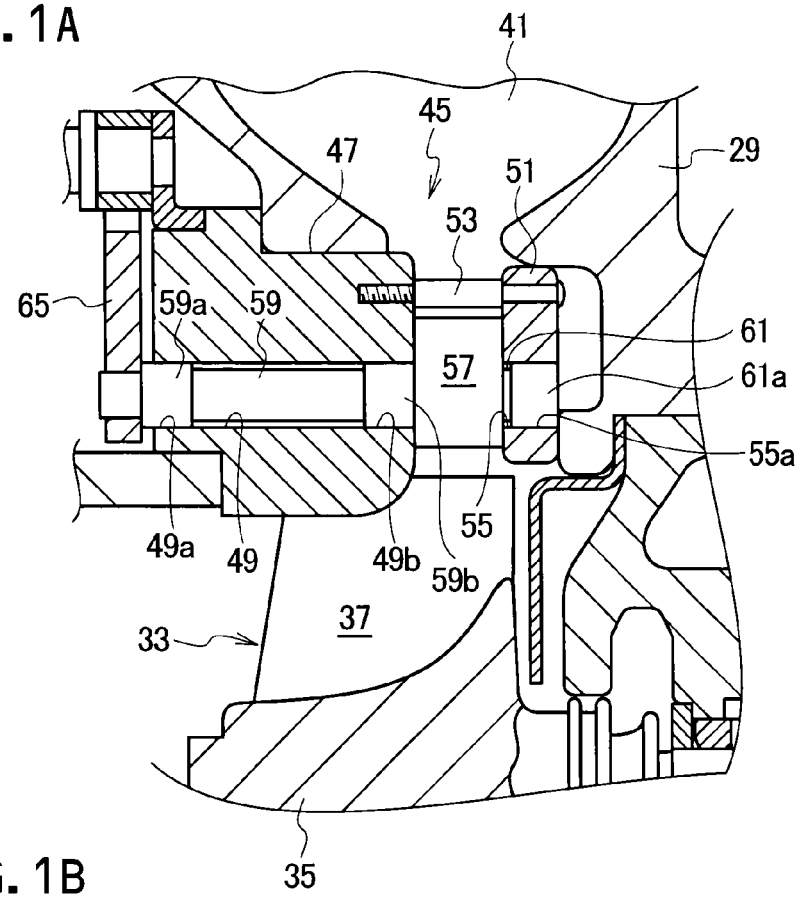
FIG. 1A is a cross-sectional view showing a characteristic portion of a variable nozzle unit according to an embodiment of the present invention.

An embodiment of the present invention will be described with reference to FIGS. 1 to 3. It should be noted that as shown in the drawings, "L" indicates the left direction, and "R" indicates the right direction.

Figure 3:
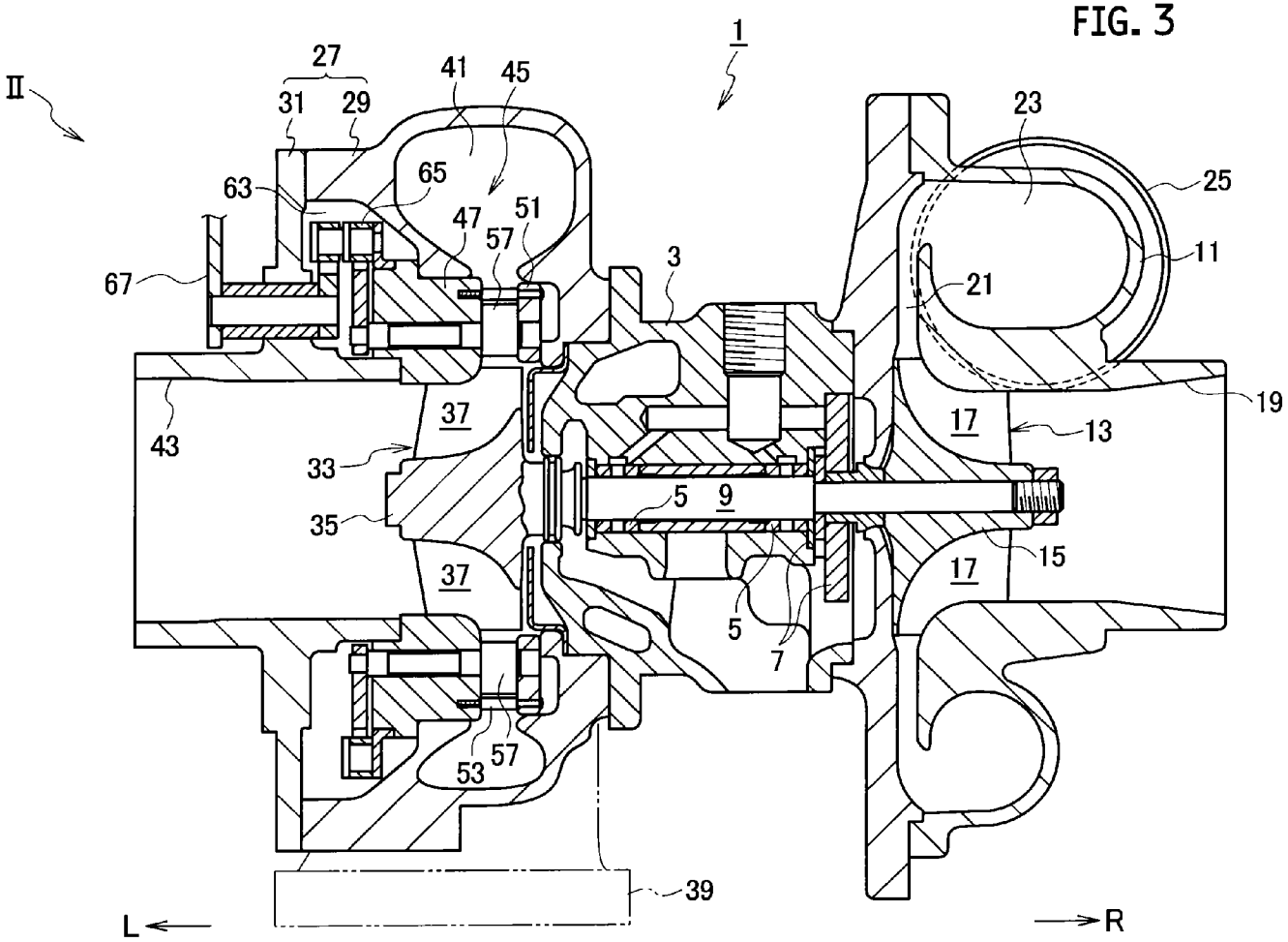
FIG. 3 is a front cross-sectional view of a variable geometry system turbocharger according to the embodiment of the present invention.

As shown in FIG. 3, a variable geometry system turbocharger 1 according to an embodiment of the present invention turbocharges (compresses) air to be supplied to an engine using the pressure energy of exhaust gas from the engine (not shown).

The variable geometry system turbocharger 1 includes a bearing housing 3. A plurality of radial bearings 5 and a plurality of thrust bearings 7 are provided in the bearing housing 3. Moreover, a rotor shaft (turbine shaft) 9 extending in the lateral direction is rotatably provided through the plurality of bearings 5 and 7. In other words, the rotor shaft 9 is rotatably provided in the bearing housing 3 with the plurality of bearings 5 and 7 interposed therebetween.

A compressor housing 11 is provided to the right of the bearing housing 3. A compressor impeller 13 configured to compress air using centrifugal force is provided in the compressor housing 11 to be rotatable about the axis thereof (in other words, the axis of the rotor shaft 9). Moreover, the compressor impeller 13 includes a compressor disk (compressor wheel) 15 integrally coupled to a right end portion of the rotor shaft 9 and a plurality of compressor blades 17 provided on an outer peripheral surface of the compressor disk 15 at equal intervals in the circumferential direction of the compressor disk 15.

The compressor housing 11 has an air inlet port 19 for introducing air, which is formed on an entrance side (right side of the compressor housing 11) of the compressor impeller 13. The air inlet port 19 can be connected to an air cleaner (not shown) for cleaning air. Moreover, an annular diffuser passage 21 configured to increase the pressure of compressed air is formed on an exit side of the compressor impeller 13 between the bearing housing 3 and the compressor housing 11. The diffuser passage 21 communicates with the air inlet port 19. Further, a volute-shaped compressor scroll passage 23 is formed in the compressor housing 11. The compressor scroll passage 23 communicates with the diffuser passage 21. Further, an air discharge port 25 for discharging compressed air is formed at an appropriate position on the compressor housing 11. The air discharge port 25 communicates with the compressor scroll passage 23. The air discharge port 25 can be connected to an intake manifold (not shown) of the engine.

Figure 2:
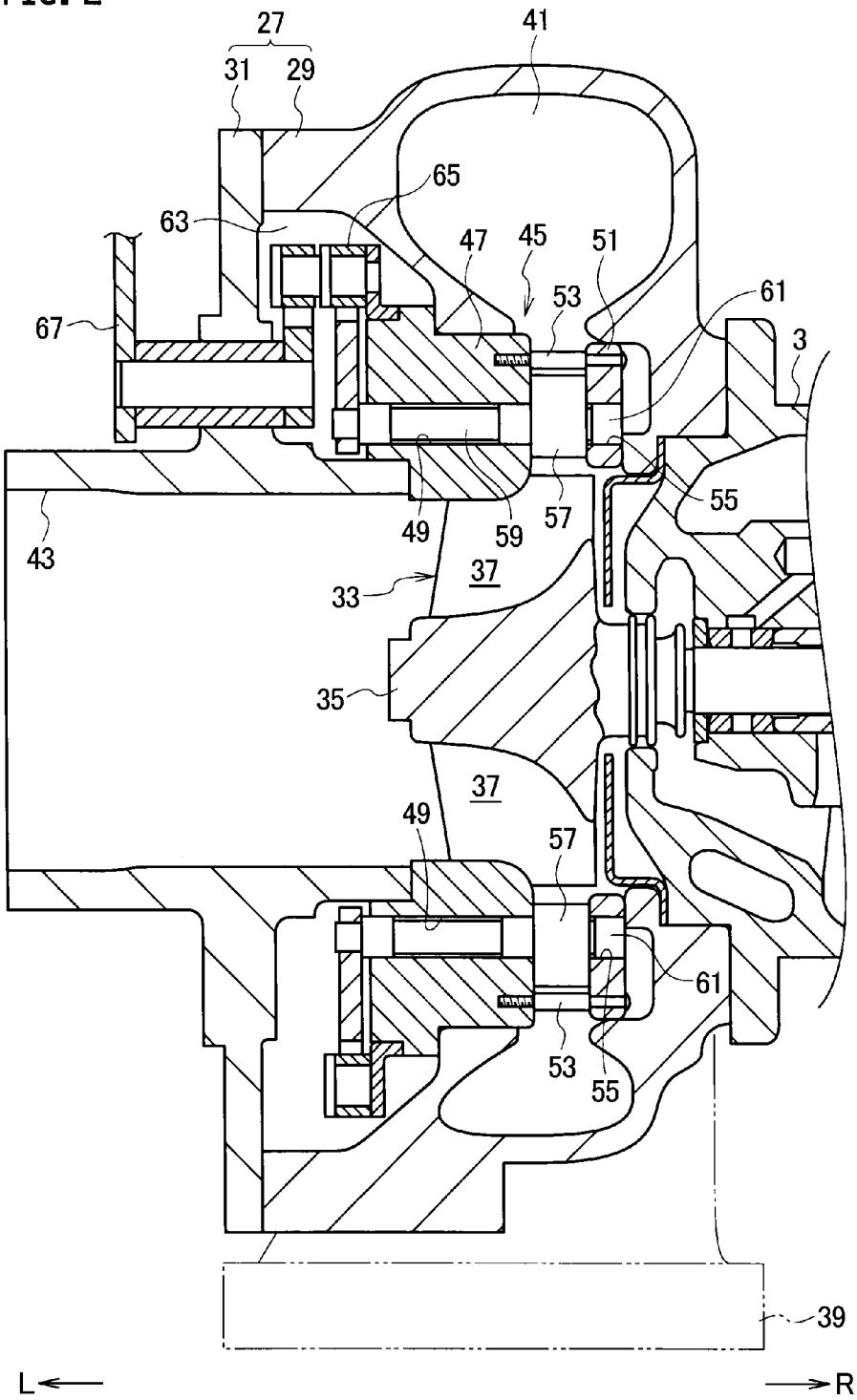
FIG. 2 is an enlarged view of a portion indicated by arrow II in FIG. 3.

As shown in FIGS. 2 and 3, a turbine housing 27 is provided to the left of the bearing housing 3. The turbine housing 27 includes a turbine housing body 29 provided to the left of the bearing housing 3 and a housing cover 31 provided to the left of the turbine housing body 29. Moreover, to generate turning force (rotating torque) using the pressure energy of exhaust gas, a turbine impeller 33 is provided in the turbine housing 27 to be rotatable about the axis thereof (the axis of the turbine impeller 33 or the axis of the rotor shaft 9). The turbine impeller 33 includes a turbine disk (turbine wheel) 35 provided integrally with a left end portion of the rotor shaft 9 and a plurality of turbine blades 37 provided on the outer peripheral surface of the turbine disk 35 at equal intervals in the circumferential direction of the turbine disk 35.

A gas inlet port 39 for introducing exhaust gas is formed at an appropriate position on the turbine housing 27 (turbine housing body 29). The gas inlet port 39 can be connected to an exhaust manifold (not shown) of the engine. Moreover, a volute-shaped turbine scroll passage 41 is formed in the turbine housing 27 (turbine housing body 29). The turbine scroll passage 41 communicates with the gas inlet port 39. Further, a gas discharge port 43 for discharging exhaust gas is formed on an exit side of the turbine impeller 33 (left side of the turbine housing 27) in the turbine housing 27 (housing cover 31). The gas discharge port 43 can be connected to an exhaust gas cleaner (not shown) for cleaning exhaust gas.

A variable nozzle unit 45 which alters the passage area (flow rate) of exhaust gas to be supplied to the turbine impeller 33 side is disposed in the turbine housing 27. The configuration of the variable nozzle unit 45 will be described below.

As shown in FIG. 2, a shroud ring 47 as a first ring base is provided in the turbine housing 27 concentrically with the turbine impeller 33. The shroud ring 47 covers the outer edges of the plurality of turbine blades 37. Moreover, a plurality of first supporting holes 49 are formed to pass through the shroud ring 47 and are equally spaced in the circumferential direction of the shroud ring 47 (or turbine impeller 33).

A nozzle ring 51 as a second base ring is provided at a position away from and facing the shroud ring 47 in the axial direction (lateral direction) of the turbine impeller 33 integrally and concentrically with the shroud ring 47 with a plurality of connecting pins 53 interposed therebetween. Moreover, a plurality of second supporting holes 55 are formed to pass through the nozzle ring 51 and are equally spaced in the circumferential direction of the nozzle ring 51 (or turbine impeller 33) in such a manner as to match the plurality of first supporting holes 49 of the shroud ring 47. A left end portion of each connecting pin 53 is integrally coupled to the shroud ring 47 with a screw. A right end portion of each connecting pin 53 is integrally coupled to the nozzle ring 51 by staking. The plurality of connecting pins 53 have the function of setting the distance between the facing surface of the shroud ring 47 and the facing surface of the nozzle ring 51. Means for coupling the connecting pin 53 to the shroud ring 47 and the nozzle ring 51 is not limited to the above-described one. Coupling these components together may be achieved by, for example, welding.

A plurality of variable nozzles 57 are disposed between the facing surface of the shroud ring 47 and the facing surface of the nozzle ring 51 at equal intervals in the circumferential direction of the shroud ring 47 and the nozzle ring 51 (or in the circumferential direction of the turbine impeller 33). Each variable nozzle 57 is rotatable in the forward and reverse directions (opening and closing directions) about an axis parallel to the axis of the turbine impeller 33. Moreover, a first nozzle shaft 59 is integrally formed on a left side surface (side surface on one side in the axial direction) of each variable nozzle 57. The first nozzle shaft 59 of each variable nozzle 57 is rotatably supported by the corresponding first supporting hole 49 of the shroud ring 47. Further, a second nozzle shaft 61 is formed on a right side surface (side surface on another side in the axial direction) of each variable nozzle 57 integrally and concentrically with the first nozzle shaft 59. The second nozzle shaft 61 of each variable nozzle 57 is rotatably supported by the corresponding second supporting hole 55 of the nozzle ring 51.

It should be noted that the distances between adjacent variable nozzles 57 need not be equal to each other in consideration of shapes and aerodynamic effects of individual variable nozzles. In such a case, the distances between the first supporting holes 49 of the shroud ring 47 and the distances between the second supporting holes 55 of the nozzle ring 51 are also set in such a manner as to match the distances between the variable nozzles 57.

An annular link chamber 63 is delimited and formed on the opposite side of the shroud ring 47 from the facing surface. A link mechanism (synchronization mechanism) 65 for synchronously rotating the plurality of variable nozzles 57 in the forward and reverse directions (opening and closing directions) is disposed in the link chamber 63. The link mechanism 65 is linked and coupled to the first nozzle shafts 59 of the plurality of variable nozzles 57. Moreover, the link mechanism 65 has a known configuration such as shown in the aforementioned Patent Literature 1 and 2. The link mechanism 65 is connected through a power transmission mechanism 67 to a motor or a rotating actuator (not shown) such as a cylinder for rotating the plurality of variable nozzles 57 in the opening and closing directions.

A nozzle supporting structure for supporting the variable nozzle 57 at both ends will be described below.

As shown in FIG. 1A, the first nozzle shaft 59 of the variable nozzle 57 has on right and left sides (both sides in the axial direction) two large-diameter portions 59*a* and 59*b* having diameters larger than a reference outside diameter (outside diameter of an intermediate portion of the first nozzle shaft 59). The large-diameter portions 59*a* and 59*b* are rotatably supported by portions of an inner surface of the first supporting hole 49 of the shroud ring 47. In other words, the inner surface of the first supporting hole 49 has on right and left sides thereof two first bearing portions 49*a* and 49*b* (portions contacting the large-diameter portions 59*a* and 59*b*) by which the first nozzle shaft 59 of the variable nozzle 57 is rotatably supported.

The outside diameter of the large-diameter portion 59*a* and the outside diameter of the large-diameter portion 59*b* are set to the same value. The inside diameter of the first bearing portion 49*a* and the inside diameter of the first bearing portion 49*b* are set to the same value. The fitting clearance between the first bearing portion 49*a* and the large-diameter portion 59*a* and the fitting clearance between the first bearing portion 49*b* and the large-diameter portion 59*b* are set to the same value to an accuracy of several tens of micrometers.

The second nozzle shaft 61 of the variable nozzle 57 has, in a portion other than a proximal end portion, a large-diameter portion 61*a* having a diameter larger than a reference outside diameter (outside diameter of the proximal end portion of the second nozzle shaft 61). The large-diameter portion 61*a* is rotatably supported by a portion of an inner surface of the second supporting hole 55 of the nozzle ring 51. In other words, the inner surface of the second supporting hole 55 has a second bearing portion 55*a* (portion contacting the large-diameter portion 61*a*) by which the second nozzle shaft 61 of the variable nozzle 57 is rotatably supported.

The inside diameter of the second bearing portion 55*a* is set to the same value as the inside diameters of the first bearing portions 49*a* and 49*b*. The outside diameter of the large-diameter portion 61*a* is set smaller than the outside diameters of the large-diameter portions 59*a* and 59*b*. The fitting clearance between the second bearing portion 55*a* and the large-diameter portion 61*a* is set with an accuracy of several hundred micrometers. In other words, the fitting clearance between the second bearing portion 55*a* and the large-diameter portion 61*a* is set larger than the fitting clearances between the large-diameter portions 59*a* and 59*b* and the first bearing portions 49*a* and 49*b*. It should be noted that the following may be employed: the outside diameter of the large-diameter portion 61*a* is set to the same value as the outside diameters of the large-diameter portions 59*a* and 59*b*, and the inside diameter of the second bearing portion 55*a* is set larger than the inside diameters of the first bearing portions 49*a* and 49*b*.

Further, in an early stage of the use of the unit (early stage of the use of the variable nozzle unit 45), the variable nozzle 57 is supported on one side from the left side (one side in the axial direction) of variable nozzle 57 by the two first bearing portions 49*a* and 49*b*. As wear between the first bearing portion 49*b* on the right side (on the other side in the axial direction) and the large-diameter portion 59*b* proceeds, the angle of inclination of the axis of the variable nozzle 57 with respect to the axis of the first supporting hole 49 of the shroud ring 47 increases. In a further advanced stage of the wear, the large-diameter portion 61*a* of the second nozzle shaft 61 comes in contact with the second bearing portion 55*a*. Finally, the variable nozzle 57 is supported on both sides from both the right and left sides of the variable nozzle 57 (both sides thereof in the axial direction) by the first bearing portion 49*a* on the left side (one side in the axial direction) and the second bearing portion 55*a*. In a state in which the variable nozzle 57 is supported on both sides by the left-side first bearing portion 49*a* and the second bearing portion 55*a*, the angle of inclination of the axis of the variable nozzle 57 with respect to the axis of the first supporting hole 49 of the shroud ring 47 is set to an angle equal to or less than a reference allowable angle of inclination. It should be noted that the reference allowable angle of inclination is an angle found in advance by testing so that the non-smooth movement of the variable nozzle 57 may be reduced.

Next, functions and effects of the embodiment of the present invention will be described.

Exhaust gas introduced through the gas inlet port 39 flows from the entrance side to the exit side of the turbine impeller 33 through the turbine scroll passage 41. The flow of the exhaust gas causes the pressure energy of the exhaust gas to generate turning force (rotating torque), which can cause the rotor shaft 9 and the compressor impeller 13 to rotate integrally with the turbine impeller 33. This rotation compresses air introduced through the air inlet port 19, and allows the compressed air to be discharged from the air discharge port 25 through the diffuser passage 21 and the compressor scroll passage 23. In other words, air to be supplied to the engine can be turbocharged (compressed).

During the operation of the variable geometry system turbocharger 1, when the number of revolutions of the engine is in a high revolution region and the flow rate of exhaust gas is high, the actuation of the link mechanism 65 by the rotating actuator causes the plurality of variable nozzles 57 to synchronously rotate in the forward direction (opening direction). As a result, the gas passage area (area of the throat of the variable nozzle 57) of exhaust gas to be supplied to the turbine impeller 33 side increases, and the amount of exhaust gas to be supplied increases. On the other hand, when the number of revolutions of the engine is in a low revolution region and the flow rate of exhaust gas is low, the actuation of the link mechanism 65 by the rotating actuator causes the plurality of variable nozzles 57 to synchronously rotate in the reverse direction (closing direction). As a result, the gas passage area of exhaust gas to be supplied to the turbine impeller 33 side decreases, the velocity of flow of exhaust gas increases, and the amount of work produced by the turbine impeller 33 is sufficiently ensured. Thus, irrespective of whether the flow rate of exhaust gas is high or low, the turbine impeller 33 can sufficiently and stably generate turning force (general function of the variable geometry system turbocharger 1).

The fitting clearance between the second bearing portion 55*a* and the large-diameter portion 61*a* is set larger than the fitting clearances between the large-diameter portions 59*a* and 59*b* and the first bearing portions 49*a* and 49*b*. Accordingly, as wear between the right-side first bearing portion 49*b* and the large-diameter portion 59*b* proceeds, the variable nozzle 57 comes to be supported on both sides from both the right and left sides of the variable nozzle 57 by the left-side first bearing portion 49*a* and the second bearing portion 55*a*. Thus, the inclination (tilting) of the axis of the variable nozzle 57 with respect to the axis of the first supporting hole 49 of the shroud ring 47 during the operation of the variable geometry system turbocharger 1 can be reduced.

Figure 1B:
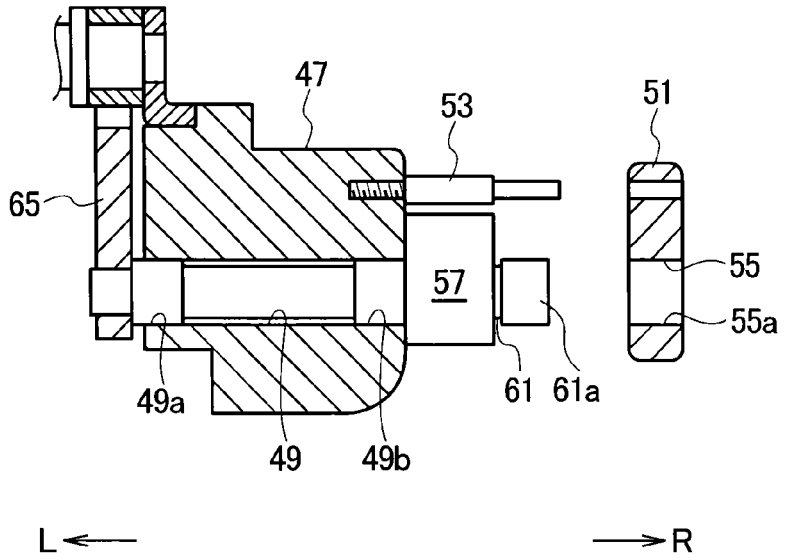
FIG. 1B is a view showing a state of the variable nozzle unit before a nozzle ring is attached to a shroud ring.

The inner surface of each first supporting hole 49 of the shroud ring 47 has the two first bearing portions 49*a* and 49*b* at the right and left ends thereof. In other words, the two first bearing portions 49*a* and 49*b* are formed in the shroud ring 47 as a single component. Accordingly, the accuracy of the relative position between the respective holes constituting the two first bearing portions 49*a* and 49*b* can be sufficiently ensured. Moreover, before the nozzle ring 51 is attached to the shroud ring 47, the variable nozzle 57 can be supported by the two first bearing portions 49*a* and 49*b* in a stable state as shown in FIG. 1B.

The fitting clearance between the second bearing portion 55*a* and the second nozzle shaft 61 of the variable nozzle 57 is set larger than the fitting clearance between each of the first bearing portions 49*a* and 49*b* and the first nozzle shaft 59 of the variable nozzle 57. Accordingly, when the nozzle ring 51 is attached to the shroud ring 47, the difference between the two fitting clearances can absorb position errors (installation errors) between respective holes of the first bearing portions 49*a* and 49*b* and the second bearing portion 55*a* (function specific to the variable geometry system turbocharger 1).

Accordingly, according to the embodiment of the present invention, the inclination of the axis of the variable nozzle 57 with respect to the axis of the first supporting hole 49 of the shroud ring 47 during the operation of the variable geometry system turbocharger 1 can be reduced. Moreover, during the operation of the variable geometry system turbocharger 1, the operation of the variable nozzle unit 45 can be stabilized by reducing the non-smooth movement of the variable nozzle 57.

Moreover, before the nozzle ring 51 is attached to the shroud ring 47, the variable nozzle 57 is supported by the two first bearing portions 49*a* and 49*b* in a stable state. Moreover, when the nozzle ring 51 is attached to the shroud ring 47, the difference between the two fitting clearances can absorb position errors between respective holes of the first bearing portions 49*a* and 49*b* and the second bearing portion 55*a*. Accordingly, the nozzle ring 51 can be attached to the shroud ring 47 without using a special jig, and the efficiency of assembly work of the variable nozzle unit 45 can be sufficiently improved.

The present invention is not limited to the description of the above-described embodiment, and can be carried out in various aspects, for example, as described below. Specifically, instead of employing the shroud ring 47 and the nozzle ring 51 as the first base ring and the second base ring, respectively, the nozzle ring 51 and the shroud ring 47 may be employed as the first base ring and the second base ring, respectively. In that case, a link mechanism (not shown) similar to the link mechanism 65 is provided in the link chamber (not shown) formed on the opposite side of the nozzle ring 51 from the facing surface. The scope of rights covered by the present invention is not limited to these embodiments. The scope of rights of the present invention also covers, for example, the case where a variable nozzle unit (not shown) having a configuration similar to that of the variable nozzle unit 45 is applied to turbo rotating machinery (not shown) such as a gas turbine (not shown) other than the variable geometry system turbocharger 1.

COMPARATIVE EXAMPLES

Comparative examples of the present invention will be described with reference to FIGS. 4 and 5. It should be noted that as shown in the drawings, "L" indicates the left direction, and "R" indicates the right direction.

Figure 4A:
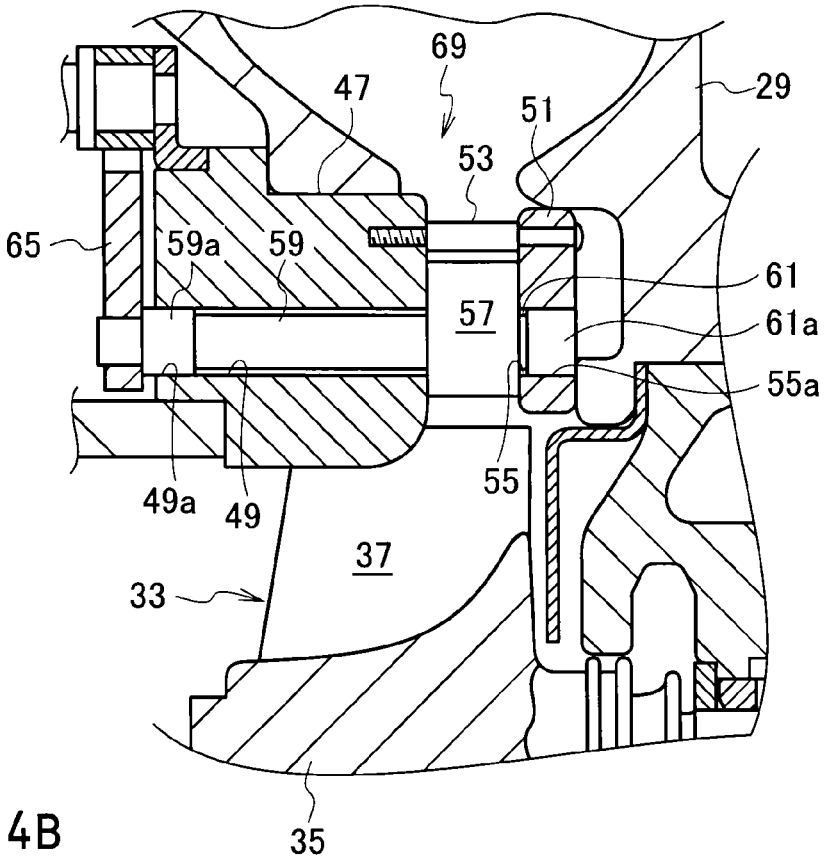
FIG. 4A is a cross-sectional view showing part of a variable nozzle unit according to comparative example 1

As shown in FIG. 4A, a variable nozzle unit 69 according to comparative example 1 corresponds to a conventional variable nozzle unit of a type in which a nozzle is supported on both sides. The variable nozzle unit 69 has a configuration similar to that of the variable nozzle unit 45 (see FIG. 1) according to the above-described embodiment of the present invention. In the following description, in the configuration of the variable nozzle unit 69 according to comparative example 1, only points different from those of the variable nozzle unit 45 will be described. It should be noted that components of the variable nozzle unit 69 according to comparative example 1 which correspond to components of the variable nozzle unit 45 are denoted by the same reference numerals in the drawings.

Figure 4B:
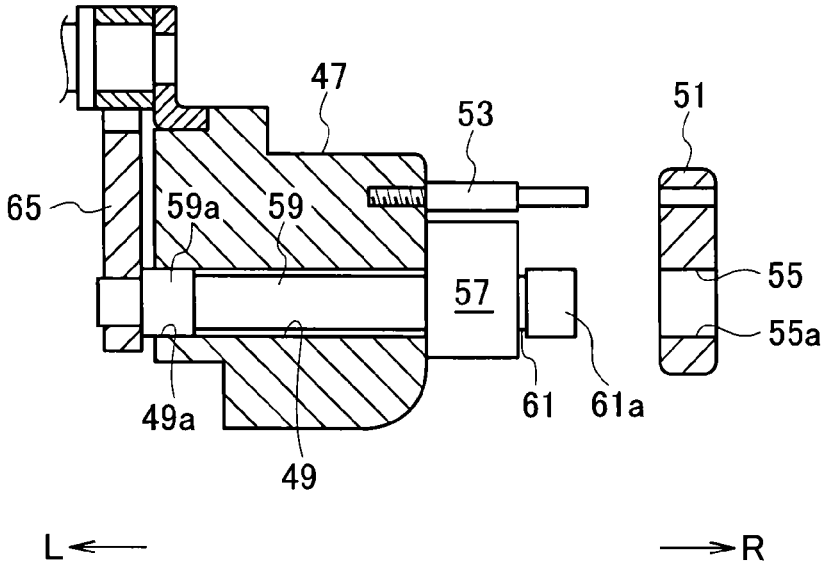
FIG. 4B is a view showing a state of the variable nozzle unit before a nozzle ring is attached to a shroud ring.

The first nozzle shaft 59 of the variable nozzle 57 has on only a left side thereof a large-diameter portion 59*a* having a diameter larger than a reference outside diameter (outside diameter of an intermediate portion of the first nozzle shaft 59). In other words, the inner surface of the first supporting hole 49 of the shroud ring 47 has on only a left side thereof a first bearing portion 49*a* by which the first nozzle shaft 59 of the variable nozzle 57 is rotatably supported. Specifically, the variable nozzle 57 is supported on both sides from both sides of the variable nozzle 57 in the axial direction by the first bearing portion 49*a* and the second bearing portion 55*a*. It should be noted that as shown in FIG. 4B, before the nozzle ring 51 is attached to the shroud ring 47, the variable nozzle 57 is supported by only one first bearing portion 49*a*.

The inside diameter of the second bearing portion 55*a* is set to the same value as the inside diameter of the first bearing portion 49*a*. The outside diameter of the large-diameter portion 61*a* is set to the same value as the outside diameter of the large-diameter portion 59*a*. The fitting clearance between the second bearing portion 55*a* and the large-diameter portion 61*a* and the fitting clearance between the first bearing portion 49*a* and the large-diameter portion 59*a* are set to the same value to an accuracy of several tens of micrometers. The bearing span between the first bearing portion 49*a* and the second bearing portion 55*a* is denoted by L1. It is assumed that wear occurs between the second bearing portion 55*a* and the large-diameter portion 61*a*, and the distance therebetween becomes X1. This wear is prone to occur when the variable nozzle 57 is subjected to a bending load due to, for example, pulsating pressure of exhaust gas or the like. In that case, the axis of the variable nozzle 57 inclines with respect to the axis of the first supporting hole 49 of the shroud ring 47 by θ1 ($\theta 1=\tan^{-1}(X1/L1)$).

Figure 5A:
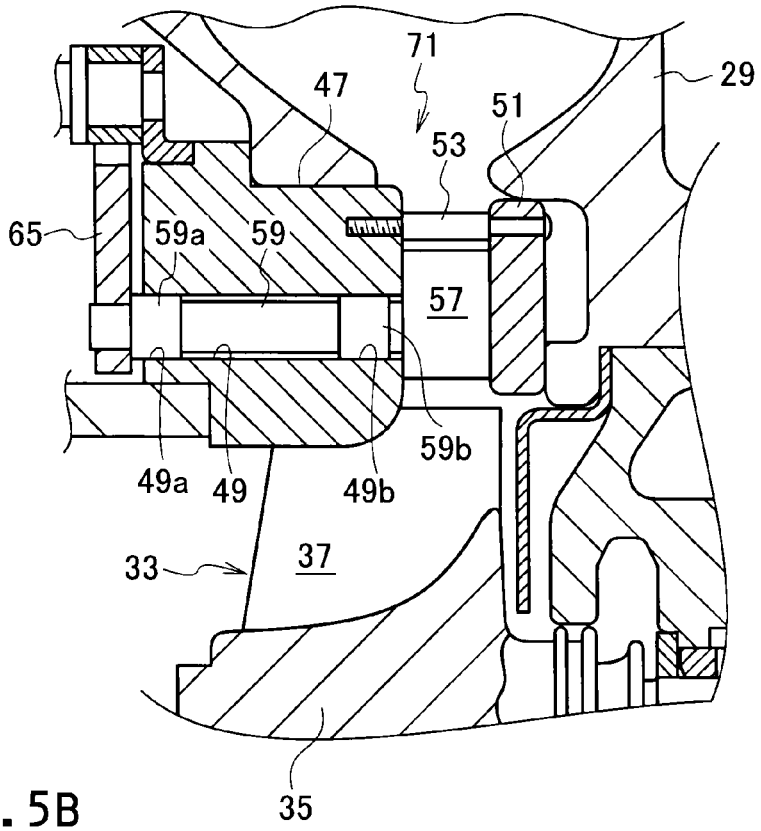
FIG. 5A is a cross-sectional view showing part of a variable nozzle unit according to comparative example 2

As shown in FIG. 5A, the variable nozzle unit 71 according to comparative example 2 corresponds to a conventional variable nozzle unit of a type in which a nozzle is supported on one side. The variable nozzle unit 71 has a configuration similar to that of the variable nozzle unit 45 according to the above-described embodiment of the present invention. In the following description, in the configuration of the variable nozzle unit 71 according to comparative example 2, only points different from those of the variable nozzle unit 45 will be described. It should be noted that components of the variable nozzle unit 71 according to comparative example 2 which correspond to components of the variable nozzle unit 45 are denoted by the same reference numerals in the drawings.

Figure 5B:
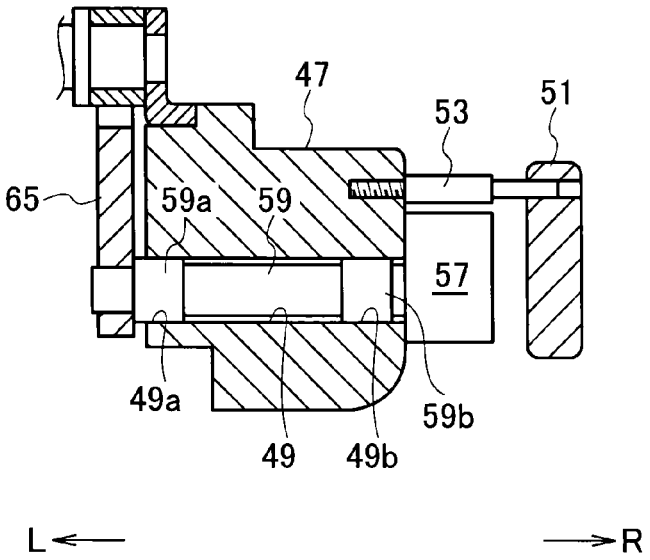
FIG. 5B is a view showing a state of the variable nozzle unit before a nozzle ring is attached to a shroud ring.

In the variable nozzle unit 71, the plurality of second supporting holes 55 (see FIGS. 1 and 2) of the nozzle ring 51 are omitted. Accordingly, the second nozzle shafts 61 (see FIG. 1) are omitted from the variable nozzles 57. In other words, the variable nozzle 57 is supported on one side from one side of the variable nozzle 57 in the axial direction by the two first bearing portions 49*a* and 49*b*. It should be noted that as shown in FIG. 5B, before the nozzle ring 51 is attached to the shroud ring 47, the variable nozzle 57 is supported by the two first bearing portions 49*a* and 49*b* in a stable state.

The bearing span between the two first bearing portions 49*a* and 49*b* is denoted by L2 (L2<L1). It is assumed that of the two first bearing portions 49*a* and 49*b*, wear occurs between the first bearing portion 49*b*, which is closer to a side surface of the variable nozzle 57, and the large-diameter portion 59*b*, and the distance therebetween becomes X2. This wear is prone to occur when the variable nozzle 57 is subjected to a bending load due to pulsating pressure of exhaust gas or the like. In that case, the axis of the variable nozzle 57 inclines with respect to the axis of the first supporting hole 49 of the shroud ring 47 by θ2 ($\theta 2=\tan^{-1}(X2/L2)$). Moreover, if X2 is equal to the amount of wear X1, the angle of inclination θ2 is larger than the angle of inclination θ1. In other words, in the case where the variable nozzle 57 is supported on one side, the inclination (tilting) of the axis of the variable nozzle 57 with respect to the axis of the first supporting hole 49 of the shroud ring 47 during the operation of the variable geometry system turbocharger 1 (see FIG. 1) can become larger than in the case where the variable nozzle 57 is supported on both sides.

The present invention is applicable to a variable nozzle unit and a variable geometry system turbocharger which can improve the working efficiency of assembling the variable nozzle unit while stabilizing the operation of the variable nozzle unit.

What is claimed is:

1. A variable nozzle unit configured to alter a passage area of gas to be supplied to a turbine impeller of turbo rotating machinery, the variable nozzle unit comprising:

a first base ring provided in a housing of the turbo rotating machinery concentrically with the turbine impeller, the first base ring including a plurality of first supporting holes formed in a circumferential direction thereof;

a second base ring provided at a position away from and facing the first base ring in an axial direction of the turbine impeller integrally and concentrically with the first base ring, the second base ring including a plurality of second supporting holes formed in a circumferential direction thereof in such a manner as to match the plurality of the first supporting holes of the first base ring;

a plurality of variable nozzles disposed between a facing surface of the first base ring and a facing surface of the second base ring in a circumferential direction of the first and second base rings, each variable nozzle being rotatable in both of forward and reverse directions about an axis parallel to an axis of the turbine impeller and including a first nozzle shaft integrally formed on a side surface thereof on one side in the axial direction and rotatably supported by the corresponding first supporting hole of the first base ring and a second nozzle shaft formed on a side surface thereof on another side in the axial direction integrally and concentrically with the first nozzle shaft and rotatably supported by the corresponding second supporting hole of the second base ring; and a link mechanism configured to synchronously rotating the plurality of variable nozzles in the forward and reverse directions, wherein an inner surface of each first supporting hole of the first base ring includes on both sides in the axial direction two first bearing portions by which the first nozzle shaft of the variable nozzle is rotatably supported, wherein an inner surface of each second supporting hole of the second base ring includes a second bearing portion by which the second nozzle shaft of the variable nozzle is rotatably supported, wherein a fitting clearance between the second bearing portion and the second nozzle shaft of the variable nozzle is set larger than a fitting clearance between each of the first bearing portions and the first nozzle shaft of the variable nozzle, and wherein a center of each second supporting hole coincides with a center of the corresponding first supporting hole in a radial direction of the first and second base rings.

2. The variable nozzle unit according to claim 1, wherein in an early stage of use of the unit, the variable nozzle is supported on one side from one side of the variable nozzle in the axial direction by the two first bearing portions, and, as wear between the first bearing portion on another side in the axial direction and the first nozzle shaft of the variable nozzle proceeds, the variable nozzle comes to be supported on both sides from both sides of the variable nozzle in the axial direction by the first bearing portion on one side in the axial direction and the second bearing portion.

3. The variable nozzle unit according to claim 2, wherein in a state in which the variable nozzle is supported on both sides by the first bearing portion on one side in the axial direction and the second bearing portion, an angle of inclination of an axis of the variable nozzle with respect to an axis of the first supporting hole of the first base ring is set to an angle equal to or less than a reference allowable angle of inclination for reducing non-smooth movement of the variable nozzle.

4. A variable geometry system turbocharger for turbocharging air to be supplied to an engine side using pressure energy of gas from the engine, the variable geometry system turbocharger comprising the variable nozzle unit according to claim 1.

5. A variable nozzle unit for turbo rotating machinery including a turbine impeller, comprising:

a first base ring provided concentrically with the turbine impeller, the first base ring including a plurality of first supporting holes formed in a circumferential direction thereof;

a second base ring provided concentrically with the first base ring, the second base ring including a plurality of second supporting holes formed in a circumferential direction thereof, a center of each second supporting hole being coincident with a center of a corresponding first supporting hole in a radial direction of the first and second base rings;

a plurality of variable nozzles rotatably disposed in a circumferential direction of the first and second base rings between the first and second base rings, each variable nozzle including:

a first nozzle shaft integrally formed and rotatably supported by the corresponding first supporting hole; and a second nozzle shaft integrally formed and rotatably supported by the corresponding second supporting hole; and a link mechanism configured to synchronously rotating the plurality of variable nozzles, wherein an inner surface of each first supporting hole includes two first bearing portions on both sides in an axial direction of the first supporting hole, the two first bearing portions being configured to rotatably support the first nozzle shaft, wherein an inner surface of each second supporting hole includes a second bearing portion configured to rotatably support the second nozzle shaft, and wherein a fitting clearance between the second bearing portion and the second nozzle shaft of the variable nozzle is set larger than a fitting clearance between each of the first bearing portions and the first nozzle shaft of the variable nozzle.

* * * * *